US008274468B2

(12) United States Patent
Hori

(10) Patent No.: US 8,274,468 B2
(45) Date of Patent: Sep. 25, 2012

(54) FLAT PANEL DISPLAY DEVICE AND DATA PROCESSING METHOD FOR VIDEO DATA

(75) Inventor: Yoshihiko Hori, Kanagawa (JP)

(73) Assignee: Renesas Electronics Corporation, Kawasaki-Shi, Kanagawa (JP)

( * ) Notice: Subject to any disclaimer, the term of this patent is extended or adjusted under 35 U.S.C. 154(b) by 1067 days.

(21) Appl. No.: 12/216,608

(22) Filed: Jul. 8, 2008

(65) Prior Publication Data

US 2009/0015519 A1 Jan. 15, 2009

(30) Foreign Application Priority Data

Jul. 9, 2007 (JP) ..... 2007-179382

(51) Int. Cl.
*G09G 3/36* (2006.01)

(52) U.S. Cl. ..... 345/100; 345/99; 345/204; 345/211; 345/213

(58) Field of Classification Search ..... 345/76–83, 345/204, 44–46, 99–100, 211, 213; 40/571–607.15
See application file for complete search history.

(56) References Cited

U.S. PATENT DOCUMENTS

| | | | | |
|---|---|---|---|---|
| 5,654,735 | A * | 8/1997 | Nakajima | 345/99 |
| 6,407,730 | B1 * | 6/2002 | Hori | 345/100 |
| 6,476,789 | B1 * | 11/2002 | Sakaguchi et al. | 345/100 |
| 6,867,759 | B1 | 3/2005 | Baek et al. | |
| 2002/0000954 | A1 * | 1/2002 | Watabu | 345/60 |
| 2002/0030648 | A1 * | 3/2002 | Yamamoto et al. | 345/87 |
| 2005/0264548 | A1 | 12/2005 | Okamura et al. | |
| 2006/0284815 | A1 * | 12/2006 | Kwon et al. | 345/98 |
| 2007/0103421 | A1 * | 5/2007 | Sekine et al. | 345/100 |
| 2007/0132701 | A1 | 6/2007 | Jeon | |

FOREIGN PATENT DOCUMENTS

| | | |
|---|---|---|
| JP | 4-281429 (A) | 10/1992 |
| JP | 2002-032064 (A) | 1/2002 |
| JP | 2002-341820 | 11/2002 |
| JP | 2003-8424 | 1/2003 |
| JP | 2003-208131 (A) | 7/2003 |
| JP | 2005-338421 (A) | 12/2005 |
| JP | 2007-164181 (A) | 6/2007 |

OTHER PUBLICATIONS

Japanese Office Action dated Apr. 12, 2012, with partial English-language translation.

* cited by examiner

*Primary Examiner* — Lun-Yi Lao
*Assistant Examiner* — Priyank Shah
(74) *Attorney, Agent, or Firm* — McGinn IP Law Group, PLLC

(57) ABSTRACT

A flat panel display includes first and second signal drivers which drive a first and second group signal lines of a display panel in accordance with an input first and second group video data respectively. A controller controls a timing of sending the first group video data to the first signal driver via the first data line, and a timing of sending the second group video data to the second signal driver via the second data line. A delay time generating section shifts a relative timing between a timing at which the first signal driver receives the first group video data and a timing at which the second signal driver receives the second video data by a determined time. The problem of the deterioration of the EMI caused by synchronization of the peak currents respectively generated in signal drivers for driving a flat panel display can be suppressed.

16 Claims, 18 Drawing Sheets

FLAT PANEL DISPLAY DEVICE AND DATA PROCESSING METHOD FOR VIDEO DATA

INCORPORATION BY REFERENCE

This Patent Application is based on Japanese Patent Application No. 2007-179382. The disclosure of the Japanese Patent Application is incorporated herein by reference.

BACKGROUND OF THE INVENTION

1. Field of the Invention

The present invention relates to a flat panel display device such as a liquid crystal display and a plasma display, and to a data processing method for video data supplied to the flat panel display device.

2. Description of Related Art

In accordance with an increase in sizes of flat-panel type display devices such as liquid crystal television sets, higher definition and smoother motion have been demanded. In order to satisfy those demands, video data of still wider band is required so that a clock speed of such device has been enhanced. However, in accordance with the increase in the clock speed and the increase in the size of the display device, an influence of power supplies and an influence of deterioration in ground impedance have been significant. Accordingly, there has been a concern over deterioration in EMI (Electromagnetic Interference).

First, an outline of a flat panel display device will be described. FIG. 1 is a block diagram for describing a flat panel display device. In FIG. 1, a flat panel display device 100 includes a timing controller 101, eight signal drivers 1 to 8 for driving signal lines, four scan drivers 104 to 107 for driving scanning lines, and a display panel 108 for displaying video data. The timing controller 101 inputs parallel data. The parallel data includes video data of red, green, and blue, and timing signals such as a horizontal synchronization signal, a vertical synchronization signal, and a clock signal. The timing controller 101 generates control signals for controlling the eight signal drivers 1 to 8 and the four scan drivers 104 to 107 based on the timing signals. Further, the timing controller 101 performs processing such as rearranging the video data, adjusting the timing, and converting the bit number in accordance with structures of the signal drivers 1 to 8.

Referring to the drawing, the timing controller 101 transmits a scan driver start pulse and a scan driver clock to each of the scan drivers 104 to 107 via a control line 102. The scan drivers 104 to 107 receives the scan driver start pulse and the scan driver clock and drives the scanning lines of the display panel 108. The timing controller 101 also transmits a signal driver start pulse and a signal driver clock to the signal drivers 1 to 8 via a control line 103, and transmits video data to the signal drivers 1 to 8 through eight data lines 11 to 18. For transferring video data between the timing controller 101 and each of the signal drivers 1 to 8, differential signals with small amplitudes based on LVDS (Low Voltage Differential Signaling) are used. The signal drivers 1 to 8 receives the signal driver start pulse, the signal-driver clock, and the video data and drive the signal lines of the display panel 108.

A structure including a single signal driver for a single display panel of the flat panel display device seems to be idealistic. However, for driving a large display panel by a single signal driver, the circuit scale of the signal driver becomes too large. This results in increasing the manufacturing cost. Further, wiring between the display panel and the signal driver becomes difficult due to the difference in their sizes. Because of theses reasons, usually, in a flat panel display devices of 10-inch class or more, a single display panel is driven by a plurality of signal drivers, as shown in FIG. 1. Similarly, a plurality of scan drivers are provided to a single display panel as well. FIG. 1 shows the flat panel display device 100 which transfers video data with a point-to-point architecture by using a plurality of data lines 11 to 18. Here, "point-to-point architecture" transfer indicates a transfer form where a data input (receiver) of a single driver is connected to one port of a data output (transmitter) built in a timing controller. However, there is also a flat panel display device which transfers video data with a multi-drop architecture by using a common data bus.

Normally, the timing for the signal driver to output a drive voltage to the display panel is every one horizontal period. However, recently, the number of a type of devices is increased, that output the drive voltage in plurality of times in one horizontal scanning period in order to improve the display characteristic. Further, in flat panel display device for some types of usage, the vertical direction and the horizontal direction are exchanged to each other.

There are various kinds of common names for the signal driver and the scan driver. In a field of liquid crystal displays, the signal driver is referred to as a source driver, and the scan driver is referred to as a gate driver, for example.

The signal drivers 1 to 8 shown in FIG. 1 will be described in details. FIG. 2 shows a block diagram for describing the configuration of the signal driver 1. Only the signal driver 1 shown in FIG. 1 will be described herein, however, the other signal drivers 2-8 also have similar circuit structures. In FIG. 2, the signal driver 1 includes an input receiver 110, a serial-parallel conversion circuit 111, an internal data bus 112, a data latch 113, a data latch 114, a D/A converter 115, and an output amplifier 116.

The input receiver 110 is a circuit which converts a signal level of receiving video data into a CMOS level that is used inside the signal driver 1, when the video data on the data line 11 is a differential signal such as LVDS.

The serial-parallel conversion circuit 111 is a circuit which converts, when video data transferred in a serial form is to be latched, the serial video data into video data of parallel mode of a certain number of bits (expressed as "one group" in this application) which is a unit of latch processing. The number of bits in one group does not necessarily be consistent with the number of bits of a processing unit inside the timing controller 101.

The internal data bus 112 is a bus which transfers the parallel-mode video data converted by the serial-parallel conversion circuit 111 to the data latch 113 by one group at a time, and it is a group of wirings in the same number of bits as that in one group.

The data latch 113 successively latches one group of video data that is converted into parallel mode by the serial-parallel conversion circuit 111, and stores the video data for the signal lines that are driven by the signal driver 1.

The data latch 114 stores, once by every horizontal period, the video data stored in the data latch 113 in order to keep a signal line drive voltage output for one horizontal period.

The D/A converter 115 selects gray-scale voltages for driving the display panel 108 based on the video data stored in the data latch 114. The output amplifier 116 is a circuit for converting impedance so as to drive the display panel 108 with low impedance, since the D/A converter 115 normally has high output impedance so that it is not possible to drive the display panel 108 directly.

As an example of a technique related to an improvement of EMI, there is an invention "DISPLAY DEVICE AND DRIVING METHOD OF THE SAME" that is disclosed in Japanese Laid-Open Patent Application JP-P2002-341820A (referred to as "patent document 1" in the following). This invention is designed to disperse peak currents generated when transferring video data from the data latch 113 to the data latch 114 shown in FIG. 2. The invention suppresses the maximum instantaneous current consumption of an active-matrix type display device. According to the patent document 1, data load instruction signals (signals for the signal electrodes to output voltages in accordance with video signals transferred to signal-side driving means) of the signal-side driving means for driving a display panel are controlled at different timings for each signal-side driving means.

As another example related to an improvement of the EMI, there is an invention "NOISE REDUCING CIRCUIT FOR SEMICONDUCTOR DEVICE" that is disclosed in Japanese Laid-Open Patent Application JP-P2003-8424A (referred to as "patent document 2" in the following). The technique disclosed in the patent document 2 is designed to overcome the issue that there is a large noise generated inside a semiconductor of a liquid crystal display data control circuit (timing controller) because an instantaneous excessive current flows concentratedly on a power supply line. A large noise that is generated because the instantaneous excessive current flows concentratedly on the power supply line in an output I/O buffer of the data control circuit (timing controller) is reduced. The technique of the patent document 2 is applied not to a point-to-point architecture flat panel display device as shown in FIG. 1 but to the multi-drop architecture flat panel display device using a common data bus. Here, "Multi-drop" type transfer indicates a transfer form where (receivers of) a plurality of drivers are connected to one port of a transmitter built in a timing controller. In the patent document 2, delay circuits are added to the output buffers of a semiconductor device that has N-numbers of outputs so as to generate phase differences for each output so as to suppress simultaneous inversion of each output from H to L or from L to H so as to suppress an excessive peak current.

SUMMARY

In the patent document 1, data load instruction signals (signals for the signal electrode to output voltages in accordance with video signals transferred to signal-side driving means) of the signal-side driving means for driving a display panel are controlled at different timings for each signal-side driving means so as to reduce the electromagnetic field noise. That is, the technique disclosed in the patent document 1 is designed to achieve reduction of the electromagnetic field noise by shifting the data load timing. However, the basic issue of the patent document 1 is the data load timing. This timing is once in every horizontal period, which is a frequency of about 100 kHz to the utmost. This frequency is much lower than a measurement-target frequency of EMI so that the contribution to the improvement of EMI is not expected.

In the patent document 2, an excessive peak current is suppressed by adding delay circuits to the output buffers of a semiconductor device that includes N-numbers of outputs, and generating phase differences for each output. However, with recent flat panel display devices, it has become common to use small-amplitude differential signals based on LVDS for transmitting data between a timing controller (data signal controlling means or data control circuit in the aforementioned case) and a signal driver (source driver in a case of a liquid crystal display device, for example, and signal-side driving means in the aforementioned case). With such video data transfer system, the output buffers are operated with a constant current. Thus, an excessive peak is not generated in the current consumed by the output buffers, even if the phase where the data is inverted is not shifted for the plurality of outputs as in the case of the patent document 2. Therefore, with regard to the technique disclosed in the patent document 2, it is not possible to improve the excessiveness of the peak current of the recent flat panel display device and the EMI.

Further, the patent document 2 does not disclose a method for controlling a delay shorter than a system clock period, even though a shorter time than a transfer clock of video data is required for a delay time. In general, it is difficult to provide a delay time difference that is stable and fine in controllability. When small-amplitude differential signals based on LVDS are employed between the timing controller and the signal driver, the video data is normally in a serial form. Thus, the frequency of signals outputted from the timing controller is an extremely high frequency such as several hundreds MHz. To control delay at this frequency leads to an increase in the cost (it is necessary to generate the timing by using PLL (Phase Locked Loop) in order to achieve a high precision and to expand a range of adjustment).

Even if a delay time difference control circuit can be manufactured at a low cost, the delay time difference depends on the performance of the circuit. Thus, depending on the circuit, the range of adjustment may become narrow and sufficient dispersion of the current peaks cannot be done. Furthermore, circuit products are influenced by deviations of the manufacturing process. Therefore, depending on a combination of circuit products with different EMI characteristics, the EMI at a specific frequency may not be improved in mass-produced flat panel display devices.

As a source for generating EMI in the flat panel display device, the following three points can be pointed. A first point is a temporal change (dIc/dt) of a current that flows on the power supply and a ground line due to an output operation of a timing controller. A second point is a temporal change (dIp/dt) of a current that flows on a transmission path. A third point is a temporal change (dId/dt) of a current that flows on a power supply and a ground line that are used in common by a plurality of signal drivers.

However, in recent large-scaled flat panel display devices, a small-amplitude differential signal (for example, LVDS signals) with low EMI for transmitting signals between the timing controller and the signal drivers is used. Thus, it is considered that the first EMI issue generated by the output operation of the controller and the second EMI issue generated by the current change in the transmission path have been almost overcome. In the meantime, a plurality of signal drivers receiving high-speed small-amplitude differential signals operate simultaneously at the time of receiving the signals. Thus, it is considered that the third EMI issue, i.e., the EMI issue generated by a peak current value (dId/dt) of the power supply and the ground line used in common by the plurality of signal drivers is a dominant problem now.

FIG. 3 illustrates a latch process performed in the signal driver 1. Note here that the other signal drivers 2 to 8 have the similar circuit structures and perform the similar operations as well. In FIG. 3, upon receiving video data from the timing controller 101, the signal driver 1 stores the video data to the data latch 113. For convenience of explanation, it is assumed that each signal line of the display panel 108 is driven by one of gray-scale voltages in sixty-four gray-scale levels. Note here that 6-bit video data is required for a single signal line, since "$2^6$=64".

The serial-parallel conversion circuit 111 inputs 6-bit video data in serial, which indicates one of gray-scale voltages of sixty-four gray-scale levels. Then, the serial-parallel conversion circuit 111 converts the 6-bit video data into a parallel form. The 6-bit parallel video data appears on the internal data bus 112, and the data latch 113 latches the 6-bit video data by one-time latch process. The data latch 113 successively latches the video data by six bits, and stores the video data of "the number of signal lines driven by the signal driver 1" times 6 bits.

FIG. 4 illustrates another latch process performed by a signal driver. The signal driver shown in FIG. 4 is different from any of the signal drivers 1 to 8 shown in FIG. 1. In FIG. 4, a serial-parallel conversion circuit 117 successively inputs of 6-bit video data in serial, which indicates one of gray-scale voltages of sixty-four gray-scale levels. Then, the serial-parallel conversion circuit 117 performs the serial-parallel conversion, and outputs 18-bit parallel video data that enable the selection of three gray-scale voltages. The 18-bit parallel video data appears on an internal data bus 118. A data latch 119 latches, by one-time latch processing, the 18-bit video data that is capable of driving three signal lines. The data latch 119 successively latches the video data by eighteen bits, and stores the video data of "the number of signal lines drive by the signal driver" times 6 bits. One group contains six bits in a case of FIG. 3, whereas one group contains eighteen bits in a case of FIG. 4.

FIGS. 5A and 5B compose an illustration showing an internal processing performed on a side of the timing controller 101. This timing controller 101 is the same as the timing controller 101 shown in FIG. 1. In FIGS. 5A and 5B, a horizontal direction shows the time axis. The timing controller 101 performs a parallel processing on the video data and performs a parallel-serial conversion on the video data. After converting the parallel video data into a serial form, the timing controller 101 outputs the serial video data to each of the data lines 11 to 18. In the drawing, it is noted that the 6-bit video data of D0[0] to D0[5] is the video data for driving a signal line #0 in the display panel 108, the 6-bit video data of D1[0] to D1[5] is the video data for driving a signal line #1 in the display panel 108, and the signal line #0 and the signal line #1 are driven by the signal driver 1.

FIGS. 6A to 6C compose an illustration showing an internal processing performed on the side of the signal driver 1. This signal driver is the same as the signal driver 1 shown in FIG. 1. In FIGS. 6A to 6C, the horizontal direction is the time axis, and the transfer time of 1-bit of the video data in FIGS. 5A and 5B is the same as the transfer time of 1-bit of the video data in FIGS. 6A to 6C. As shown in FIGS. 5A, 5B and FIGS. 6A to 6C, the timing at which the timing controller 101 sends out the video data is substantially the same as timing at which the signal driver 1 receives the video data.

Firstly, after the time within which the serial-parallel conversion circuit 111 reconstructs a parallel video data from the video data received in a serial form, the signal driver 1 outputs one group of video data D0[0] to D0[5] to the internal data bus 112. Then, after the passage of time for transferring one group of video data, the serial-parallel conversion circuit 111 outputs one group of video data D1[0] to D1[5].

The data latch 113 latches the video data appeared on the internal data bus 112 by one group at a time. With this latch processing, a large amount of current is consumed in the signal driver 1 every time the one group of video data is switched. That is, the peak currents generated in the internal data bus 112 and the data latch 113 of the signal driver 1 are generated at the timings shown in FIGS. 6A to 6C. A transfer rate of the video data flown on the internal data bus 112 of the signal driver 1 is designed to be at 10 to 50M groups/second approximately. Thus, a noise generated in the latch processing of the data latch 113 is at about the frequencies that affect EMI in particular, including higher harmonic wave components.

FIGS. 7A to 7I compose an illustration showing peak currents in an entire flat panel display device. The signal drivers 1 to 8 shown in FIGS. 7A to 7I are the same as the signal drivers 1 to 8 that are shown in FIG. 1. In FIGS. 7A to 7I, the horizontal direction is the time axis. The timing controller 101 distributes video data that corresponds to one line of the display panel 108, and transmits it to the eight signal drivers 1 to 8 at a same timing. The eight signal drivers 1 to 8 receive the video data at the same timing, and perform the latch processing on the video data by one group at a time at the same timing. Thus, the peak currents are generated in the internal data buses and the data latches of each of the signal drivers 1 to 8 at the same timing. As described, the peak currents generated in a plurality of signal drivers are generated at the same timing in the entire flat panel display device, thereby deteriorating EMI.

In an aspect of the present invention, a flat panel display includes: a display panel; a first signal driver configured to receive a first group video data and drive a first group signal line of the display panel in accordance with the first group video data; a second signal driver configured to receive a second group video data and drive a second group signal line of the display panel in accordance with the second group video data; a first data line; a second data line; a controller configured to control a timing of sending the first group video data to the first signal driver via the first data line, and a timing of sending the second group video data to the second signal driver via the second data line; and a delay time generating section configured to shift a relative timing between a timing at which the first signal driver receives the first group video data and a timing at which the second signal driver receives the second video data by a determined time.

According to such a configuration, the timing at which the first signal driver receives a video data and the timing at which the second signal driver receives the video data are relatively shifted at a determined time by the delay time generating section. As a result, a peak of the current consumption of the latch process in which the first signal driver latches the first group video data and that of the latch process in which the second signal driver latches the second group video data are relatively shifted to each other in a determined time. Therefore, the EMI of an entire flat panel display device can be improved.

According to the present invention, it is possible to improve EMI by dispersing the peak currents generated in each signal driver in the entire flat panel display device.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF THE PREFERRED EMBODIMENTS

Hereinafter, a flat panel display device and a data processing method for the video data according to embodiments of the present invention will be described with reference to the attached drawings.

Figure 1:
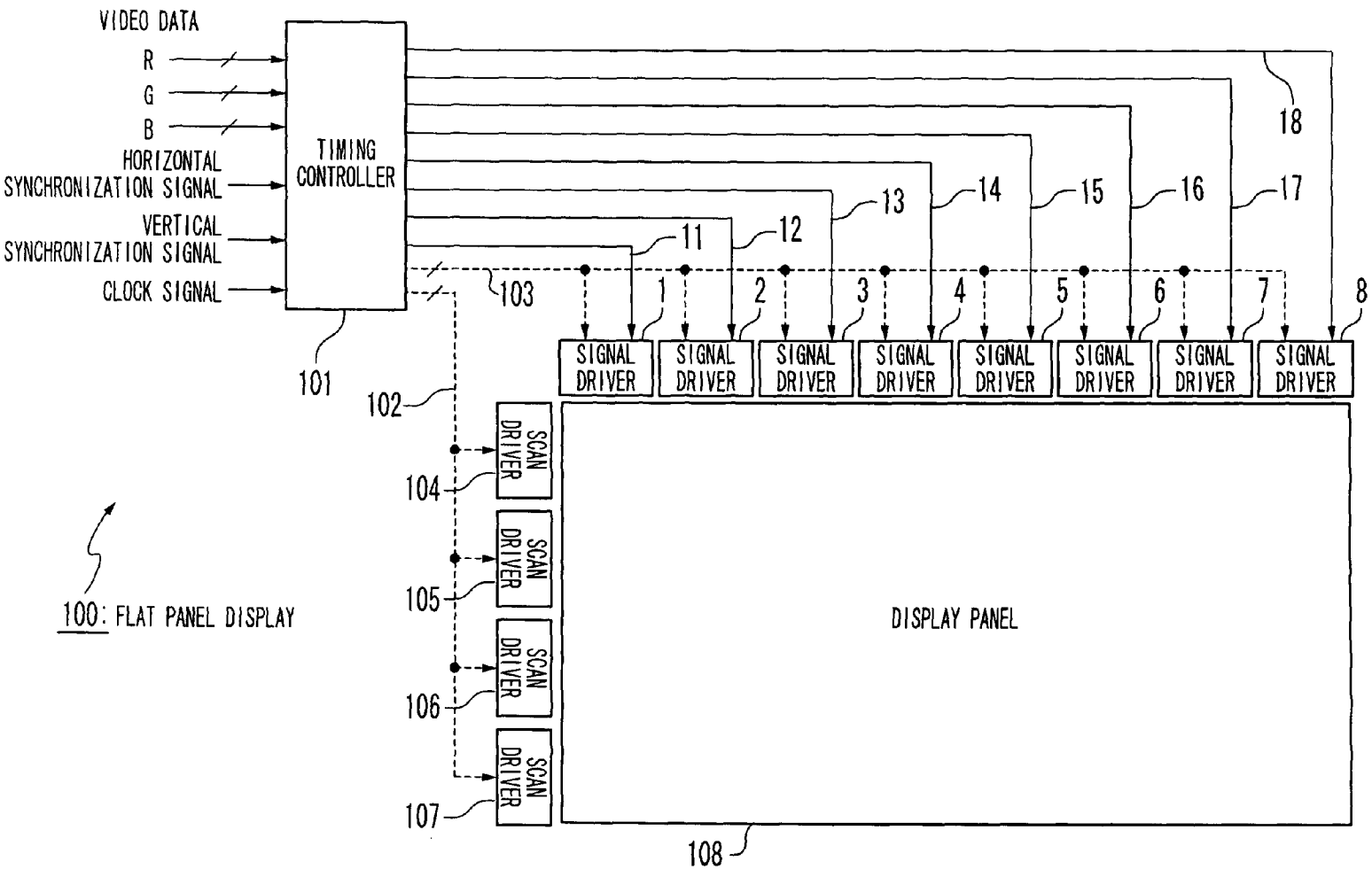
FIG. 1 is a block diagram for describing a flat panel display device.
Figure 2:
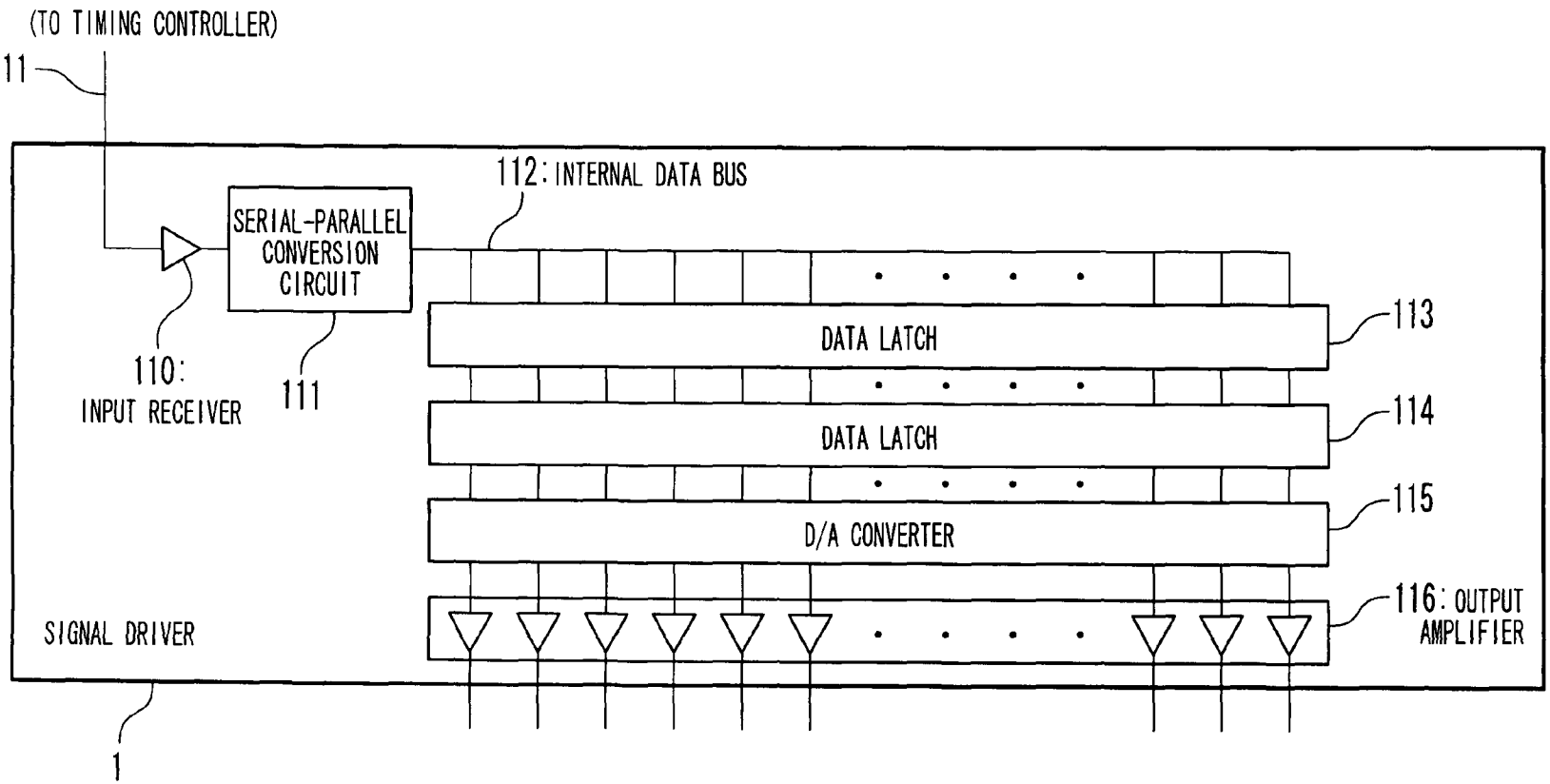
FIG. 2 is a block diagram for describing a signal driver.
Figure 3:
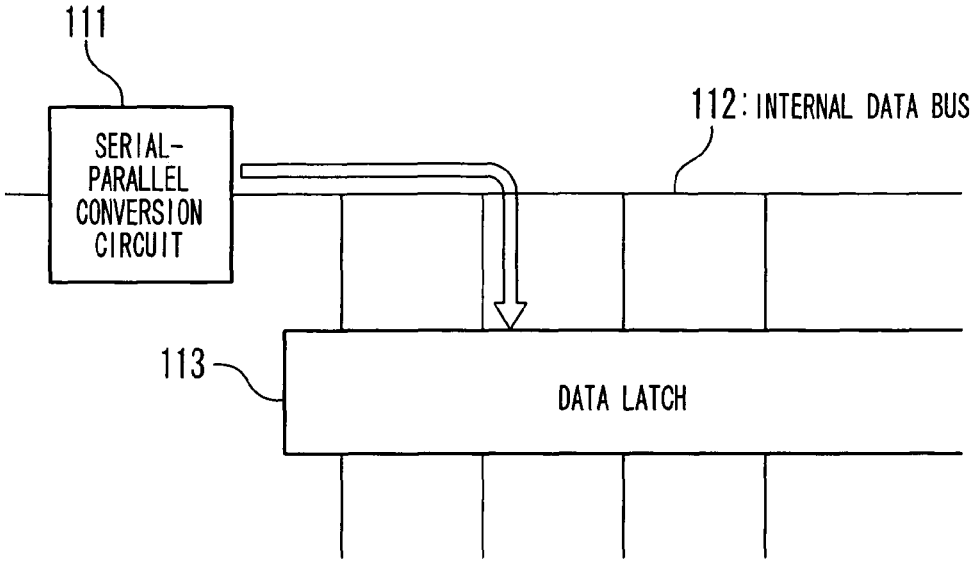
FIG. 3 is an illustration for describing latch processing performed in the signal driver.
Figure 4:
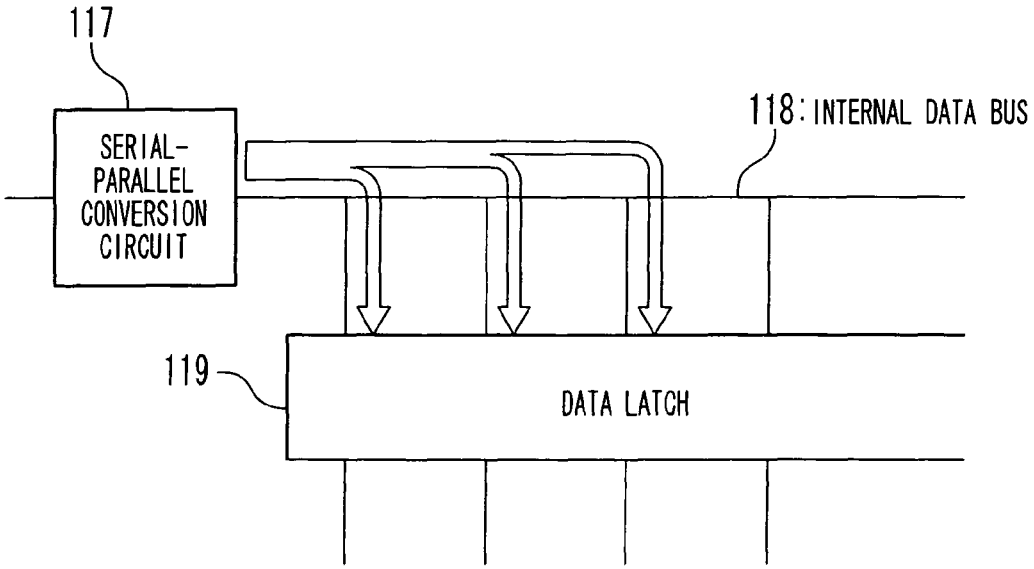
FIG. 4 is an illustration for describing another latch processing performed in the signal driver.
Figure 5:
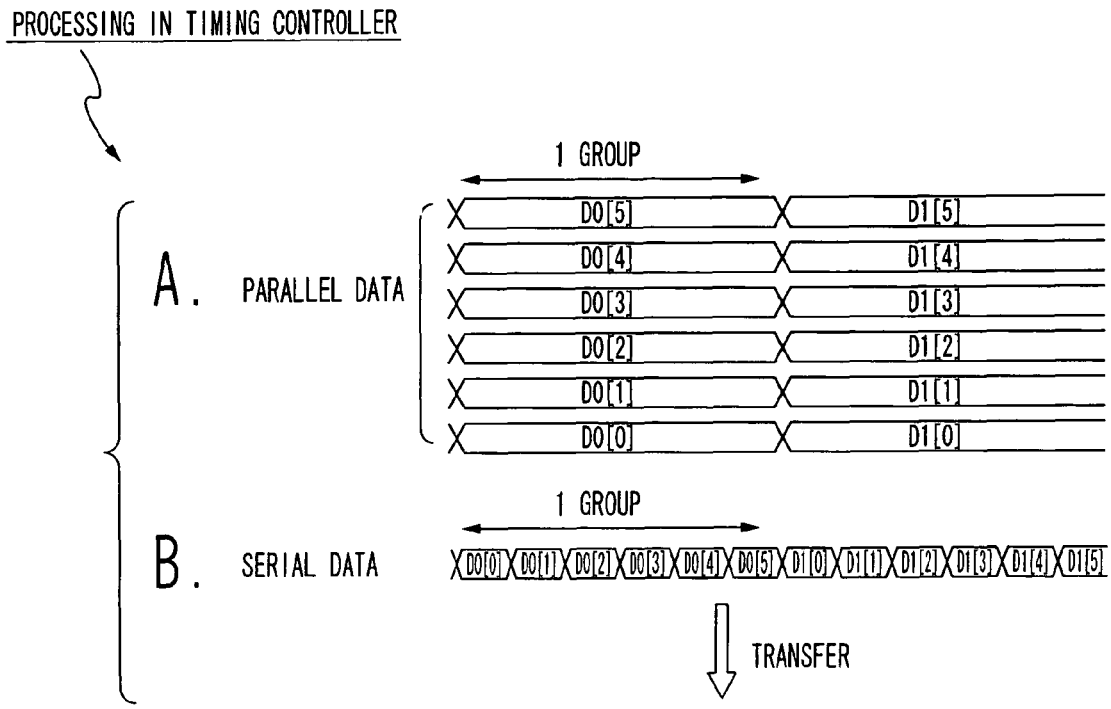
FIGS. 5A and 5B compose an illustration for describing internal processing performed on a side of a timing controller.
Figure 6:
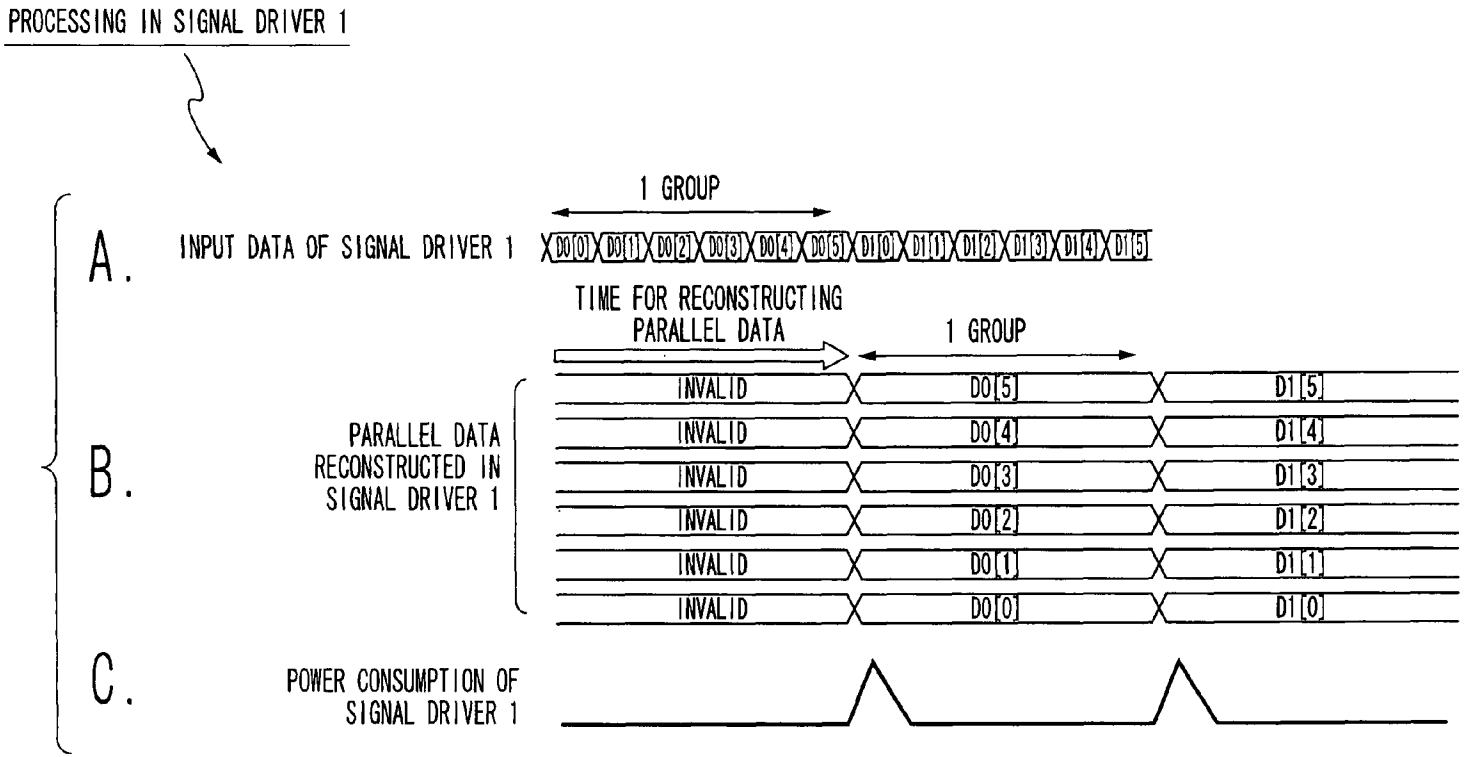
FIGS. 6A to 6C compose an illustration for describing internal processing performed on a side of the signal driver.
Figure 7:
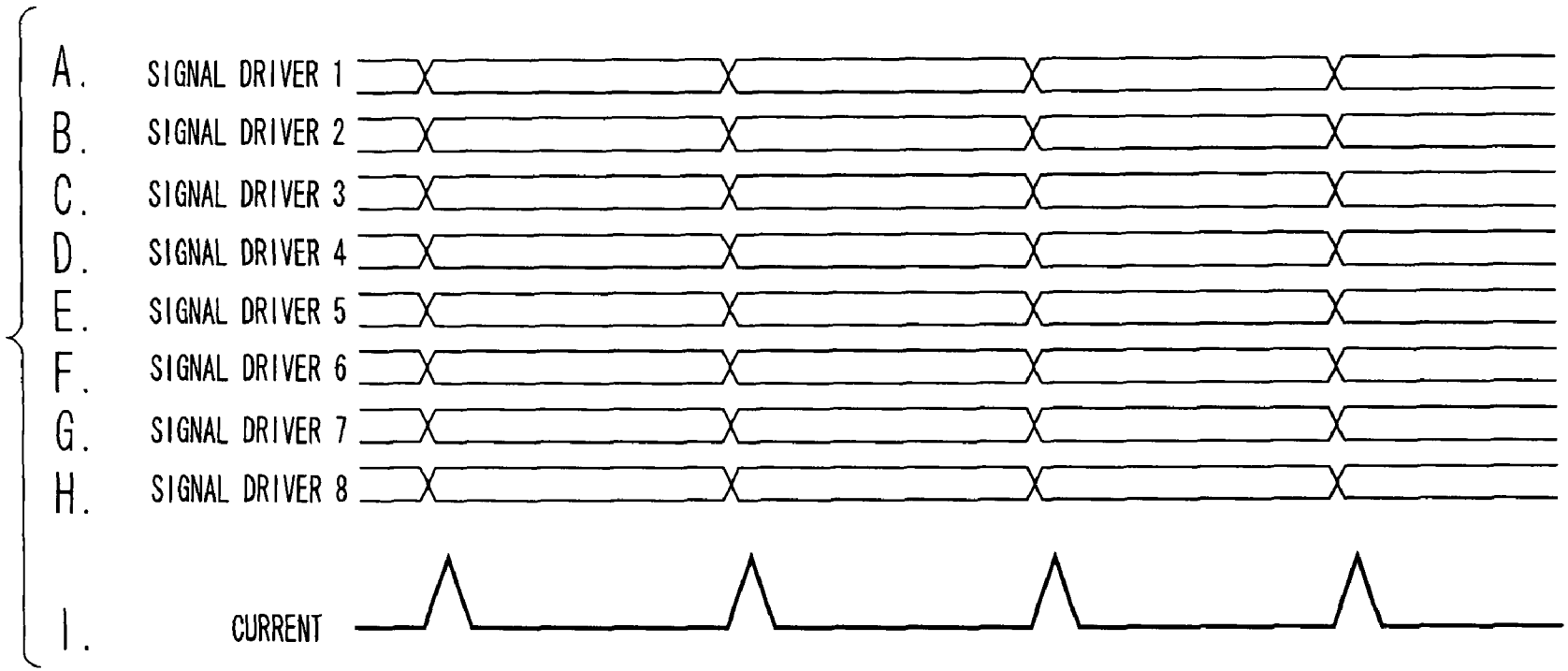
FIGS. 7A to 7I compose an illustration for describing peak currents generated in the entire flat panel display device.

(1) As shown in FIG. 1, a flat panel display device 100 is constituted roughly with a timing controller 101, signal drivers 1 to 8, scan drivers 104 to 107, a display panel 108, and data lines 11 to 18 which connect the timing controller 101 and the signal drivers 1 to 8. Among those, the timing controller 101, the signal drivers 1 to 8, and the data lines 11 to 18 are the factors that have large influences on the EMI.

In this embodiment, a point-to-point architecture and the small-amplitude serial data transfer architecture for transmitting signals between the timing controller 101 and the plurality of signal drivers 1 to 8 are employed so as to overcome the EMI issue caused due to the timing controller 101 and the EMI issue caused due to the data lines 11 to 18.

Further, in this embodiment, deterioration of the EMI caused due to the signal driver 1-8 can also be improved. In many cases, a plurality of signal drivers are loaded on a flat panel display device for a television set. In order to improve such EMI caused due to the signal drivers, output timings of each video data outputted from the timing controller are shifted. Specifically, a method in which time differences each of which is an integral multiple of a transfer clock cycle is provided by using a transfer clock of serial data transmission is employed. This method is considered as a preferable method that can be applied simply and easily. In addition, by changing the time difference of each output terminal of the timing controller periodically, it is possible to improve the EMI further. This makes it possible to obtain output time differences of video data with fine precision and controllability for each output terminal of the timing controller. Therefore, the timings of the operations of the plurality of signal drivers that receive the video data can be varied for each signal driver. Accordingly, it becomes possible to shift the relative timings of peaks of the currents on the ground line and the power supply used in common by the plurality of signal drivers temporally. As a result, generation of the EMI in the flat panel display device that uses the plurality of signal drivers can be suppressed, thereby improving the EMI characteristic of the entire device.

Figure 8:
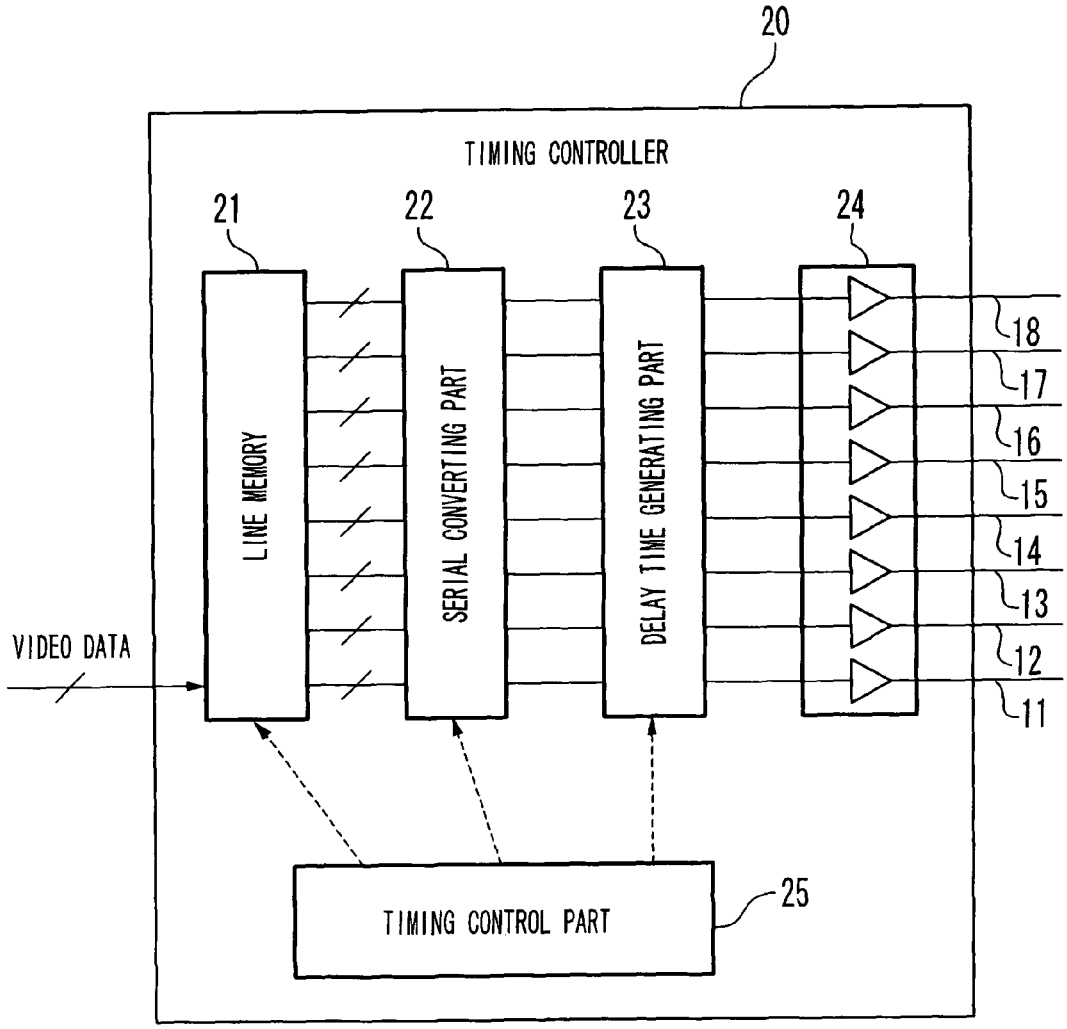
FIG. 8 is a block diagram for describing a timing controller according to an embodiment of the present invention.

(2) A flat panel display device according to an embodiment is described hereinafter in details. In the flat panel display of this embodiment, the timing controller 101 of the flat panel display device 100 shown in FIG. 1 is replaced with a timing controller 20 shown in FIG. 8. FIG. 8 shows a block diagram of the timing controller according to this embodiment. In FIG. 8, the timing controller 20 includes a line memory 21, a serial converting part 22, a delay time generating part (or delay time generating section) 23, an output amplifier 24, and a timing control part 25.

The line memory 21 works as a buffer for distributing video data for one line of the display panel 108 to each of the signal drivers 1 to 8. The line memory 21 is in a double-buffer structure so that writing and reading can be performed in parallel. In a given horizontal synchronizing period, video data for one line of the display panel 108 is written to one buffer in serial, and the video data for one line of the display panel 108 is reading from another buffer at the same time in parallel. In the next horizontal period, the video data for one line of the display panel 108 is read from the one buffer in parallel, and the video data for one line of the display panel 108 is written to the another buffer in serial at the same time. The line memory 21 distributes the video data for one line of the display panel 108 to the eight signal drivers 1 to 8, and outputs the eight pieces of video data in parallel.

The serial converting part 22 inputs eight pieces of video data in parallel, performs parallel-serial conversion, and outputs the eight pieces of video data in serial.

The delay time generating part 23 inputs the eight pieces of video data in serial, adds each of delay times $\Delta t0$, $\Delta t1$, - - - , $\Delta t7$ to the respective video data, and outputs the eight pieces of video data in serial.

The output amplifier 24 outputs the eight pieces of video data to which the respective delay times are added to each of the data lines 11 to 18.

The timing control part 25 sends out control signals to the line memory 21, the serial converting part 22, and the delay time generating part 23.

Figure 9:
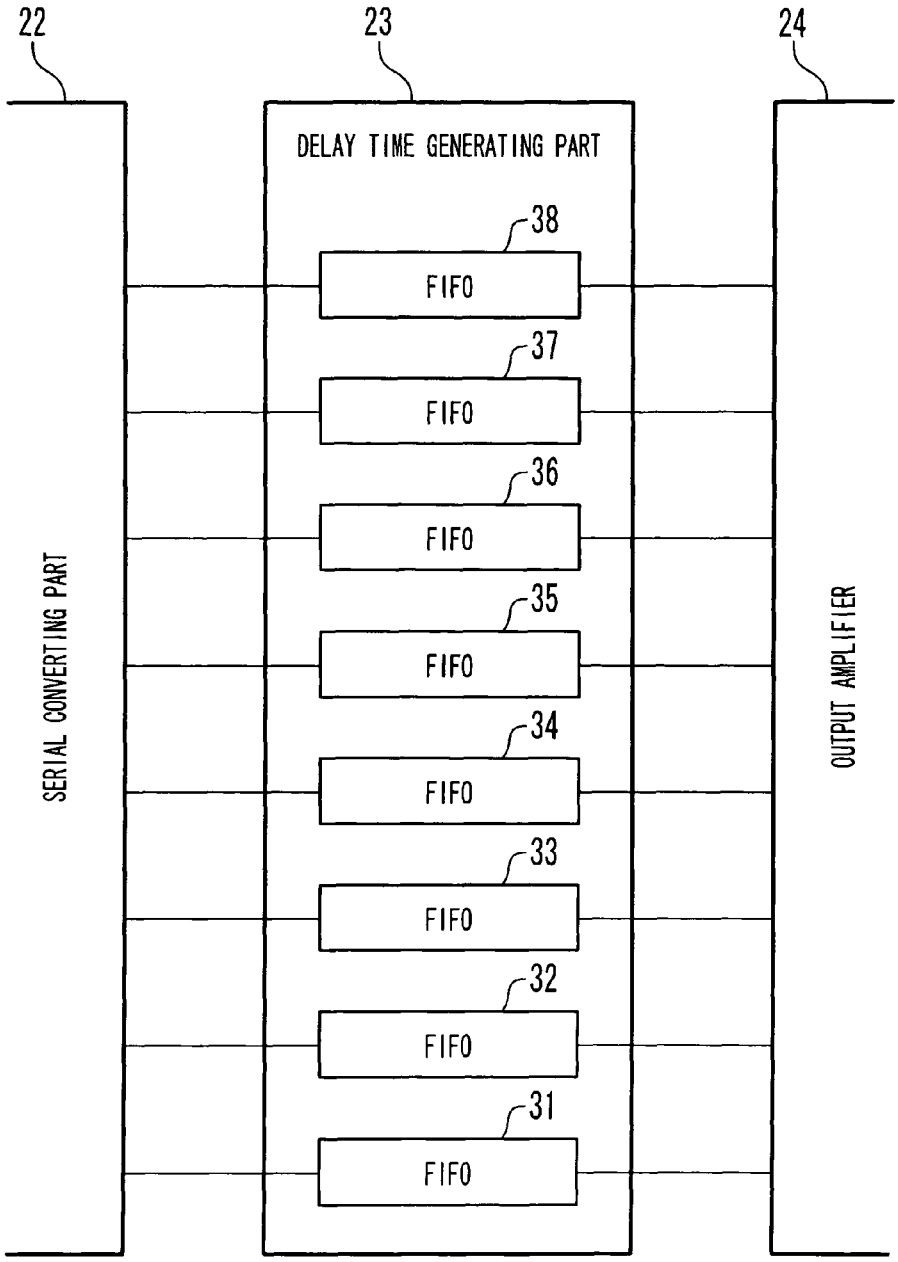
FIG. 9 is a block diagram for describing a delay time generating part.

FIG. 9 shows a block diagram of the delay time generating part 23. As shown in the drawing, the delay time generating part 23 includes eight FIFO (First-In, First-Out) memories 31 to 38. In this embodiment, the timings for transferring the video data to each of the signal drivers 1 to 8 are shifted by using the FIFO memories 31 to 38. This is because it is possible with the FIFO memories 31 to 38 to control the shift amounts of the delay time easily by simply setting reading addresses or the like, as will be described later.

Figure 10:
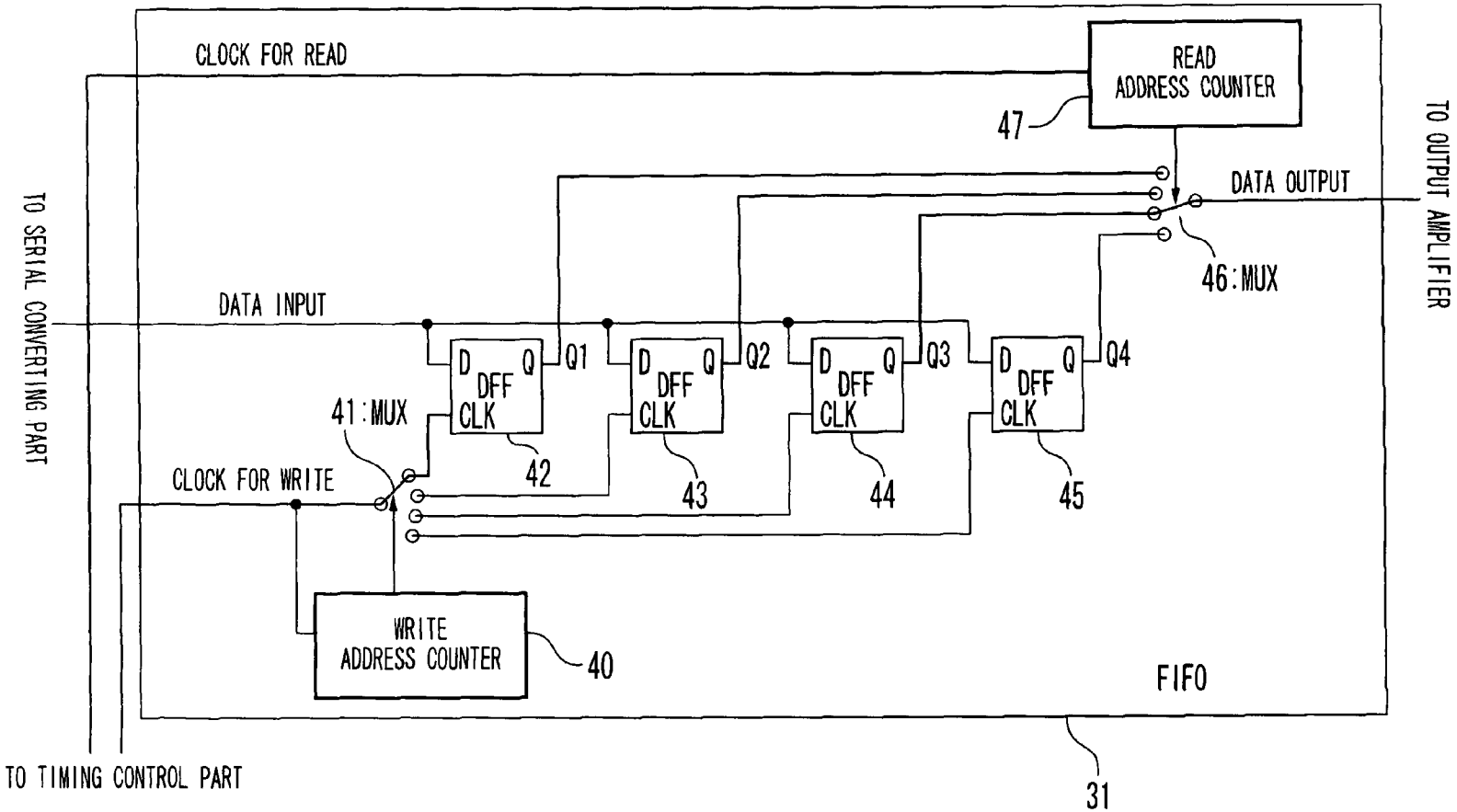
FIG. 10 is a circuit block diagram of a FIFO memory.

The FIFO memories 31 to 38 will be described in details. FIG. 10 shows a circuit block diagram of the FIFO memory 31. Only the FIFO memory 31 shown in FIG. 9 will be described herein, however, the other FIFO memories 32 to 38 also have the similar circuit structures. In FIG. 10, the FIFO memory 31 includes a write address counter 40, a write multiplexer 41, four flip-flop circuits 42 to 45, a read multiplexer 46, and a read address counter 47.

The write address counter 40 counts clock for writes as - - - , 0, 1, 2, 3, 0, 1, 2, 3, 0, - - - , and outputs the count value.

The write multiplexer 41 selects the flip-flop circuits 42 to 45 corresponding to a value counted by the write address counter 40, and supplies a clock for write to the selected flip-flop circuits 42 to 45. The four flip-flop circuits 42 to 45 latch the video data at an edge of the clock for write, and keep an output of the video data until a next clock for write is supplied. The read address counter 47 counts clock for read as - - - , 0, 1, 2, 3, 0, 1, 2, 3, 0, - - - , and outputs the count value. The read multiplexer 46 selects the flip-flop circuits 42 to 45 corresponding to the value counted by the read address counter 47, and sends out the video data outputted from the selected flip-flop circuits 42 to 45 to the output amplifier 24.

Figure 11:
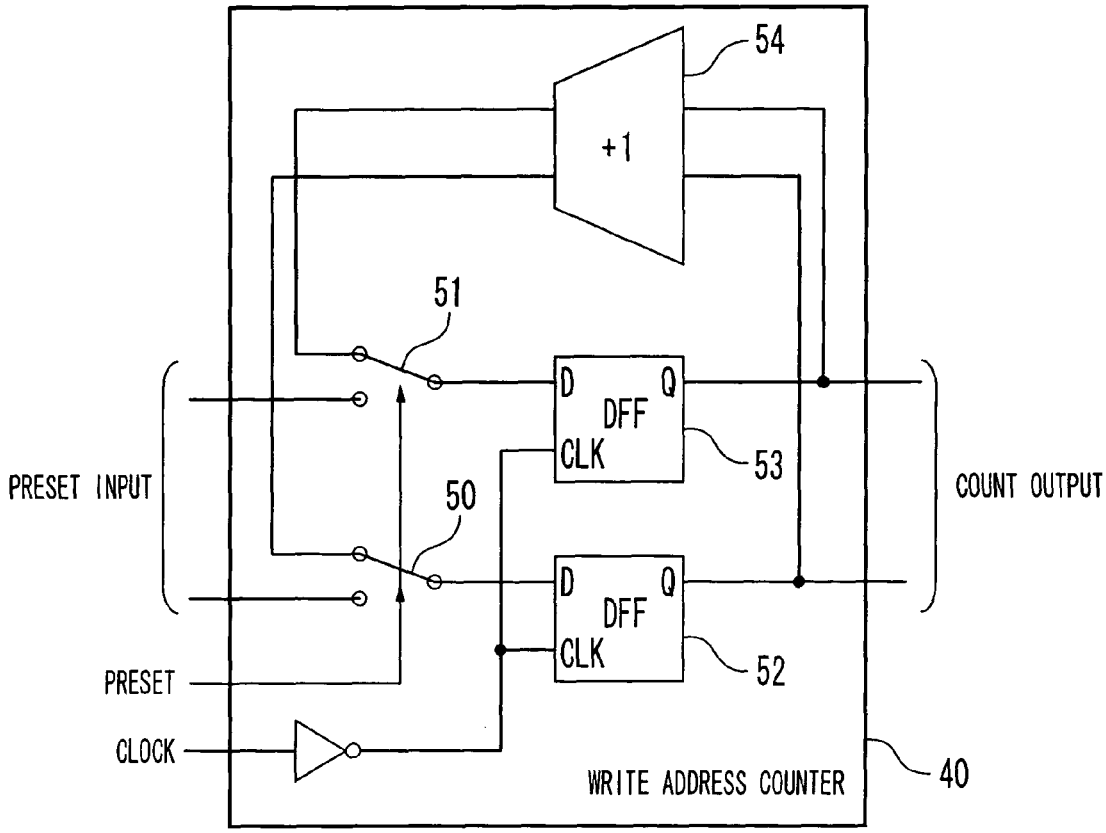
FIG. 11 is a circuit block diagram of a write address counter.
Figure 12:
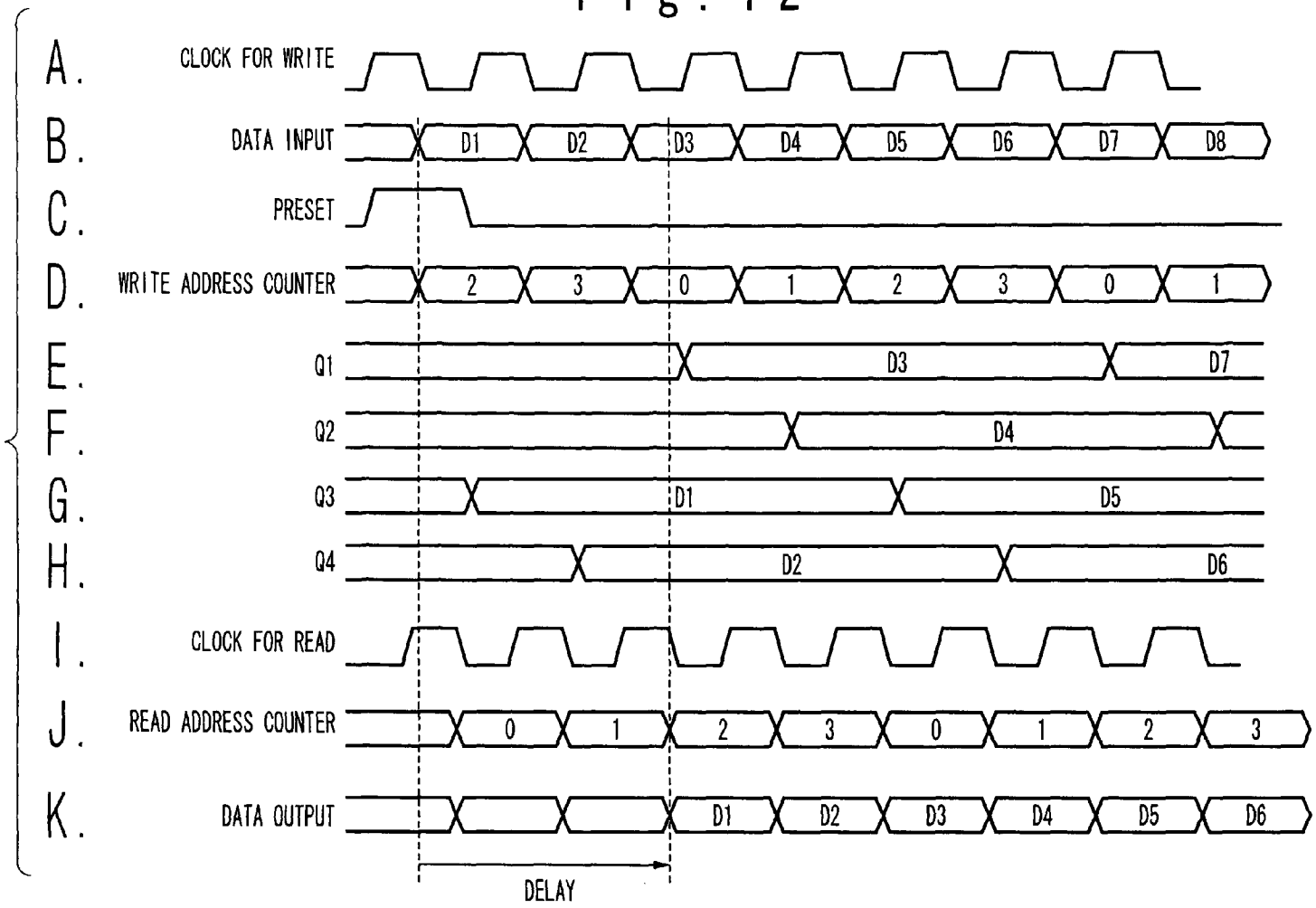
FIGS. 12A to 12K compose a timing chart for describing operations of the FIFO memory.

FIG. 11 shows a circuit block diagram of the write address counter 40. Only the write address counter 40 shown in FIG. 10 will be described herein, however, the read address counter 47 also has a similar circuit structure. In FIG. 11, the write address counter 40 includes a low-order bit multiplexer 50, a high-order bit multiplexer 51, a low-order bit flip-flop circuit 52, a high-order bit flip-flop circuit 53, and an adder 54. The low-order bit multiplexer 50 and the high-order bit multiplexer 51 select a preset input when a preset signal is set ON, and set an initial value to the respective flip-flop circuits 52 and 53. Further, the low-order bit multiplexer 50 and the high-order bit multiplexer 51 select an output of the adder 54 while the preset signal is OFF. At this time, the flip-flop circuits 52 and 53 latch the output of the adder 54 at a fall edge of the clock for write, and output the value thereof as a count output. The adder 54 increments two-digit binary values outputted from the flip-flop circuits 52 and 53.

FIGS. 12A to 12K compose a timing chart for describing operations of the FIFO memory 31. Only the FIFO memory 31 will be described herein, however, the other seven FIFO memories 32 to 38 also have similar circuit structures as that of the FIFO memory 31 and operate in a same manner as well. In FIGS. 12A to 12K, the FIFO memory 31 inputs the clock for write, the clock for read, and video data D1, D2, D3, - - - . When the preset signal is set ON, an initial value "2" is set in the write address counter 40, and an initial value "0" is set in the read address counter 47. Due to a difference in the initial values, the FIFO memory 31 can generate delay time for two transfer clocks of the video data. The write address counter 40 counts the clock at a rise edge of the clock for write, and the read address counter 47 counts the clock at a fall edge of the clock for write. As shown in the drawing, a phase of the clock for read is shifted from that of the clock for write. With this, the FIFO memory 31 can perform more precise control of the delay time. In FIGS. 12A to 12K, the data outputs of the FIFO memory 31 are to be the outputs of any of the flip-flop circuits 42 to 45 corresponding to the values counted by the read address counter 47. For example, when the value counted by the read address counter 47 is "2", an output Q3 of the flip-flop circuit 44 becomes the data output of the FIFO memory 31. When the value counted by the read address counter 47 is "3", an output Q4 of the flip-flop circuit 45 becomes the data output of the FIFO memory 31.

The delay times Δt0, Δt1, - - - , Δt7 generated by the timing controller 20 can be set arbitrarily within a range of the time obtained by "transfer clock cycle of video data" times "the number of bits in one group of video data," respectively. Further, at least one delay time is desirable to be a time that exceeds "transfer clock cycle of video data" in order to improve the EMI sufficiently. The timing controller 20 generates the delay times Δt0, Δt1, - - - , Δt7 after serial conversion. While this method is the simplest, it is also possible to generate the delay times Δt0, Δt1, - - - , Δt7 before a serial conversion or at the timing of reading out the video data from the line memory 21. Further, the generating means of the delay times Δt0, Δt1, - - - , Δt7 is not necessary limited to the FIFO memory.

Figure 13:
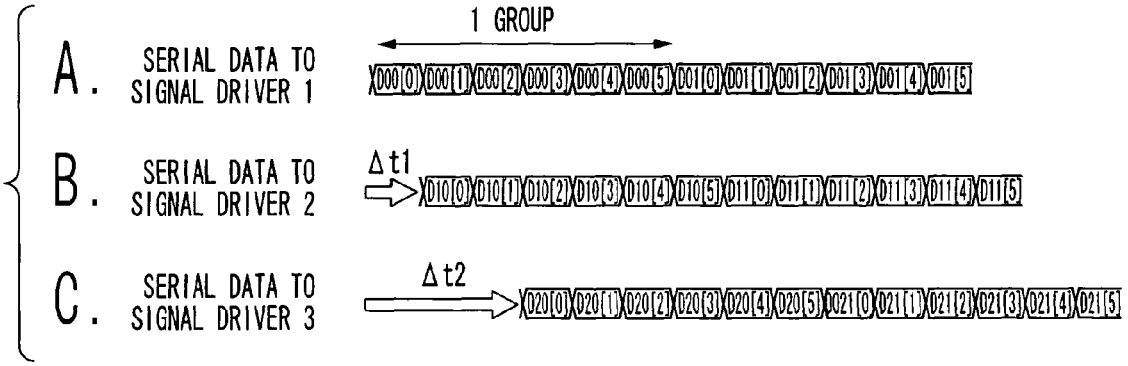
FIGS. 13A to 13C compose an illustration showing an example of timing at which the timing controller sends out video data.

(3) The timing controller 20 according to this embodiment has been described heretofore. Subsequently, the current consumption of the signal drivers 1 to 8 will be described. For simplifying the explanations, only the signal drivers 1 to 3 will be discussed hereinafter by referring to FIGS. 13A to 13C and FIGS. 15A to 15D. FIGS. 13A to 13C compose an example of the timings at which the timing controller sends out three pieces of video data in a serial form to each of the data lines 11 to 13. In FIGS. 13A to 13C, the FIFO memory 31 in the delay time generating part 23 generates Δt0=0 as a delay time, the FIFO memory 32 generates Δt1="transfer clock cycle of video data", and the FIFO memory 33 generates Δt2="transfer clock cycle of video data" times 3.

Figure 14:
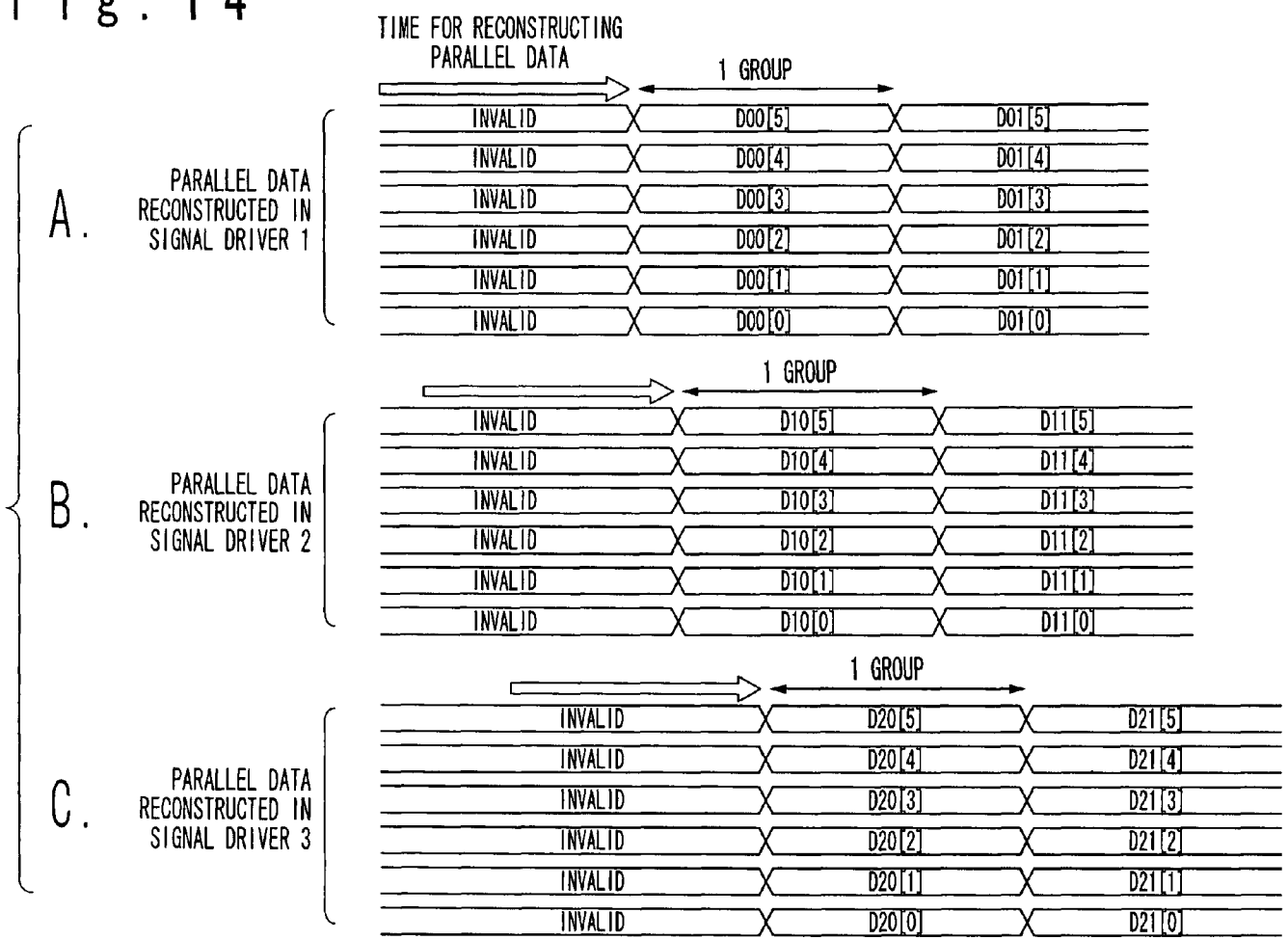
FIGS. 14A to 14C compose an illustration showing timing at which parallel-converted video data appears on an internal data bus.
Figure 15:
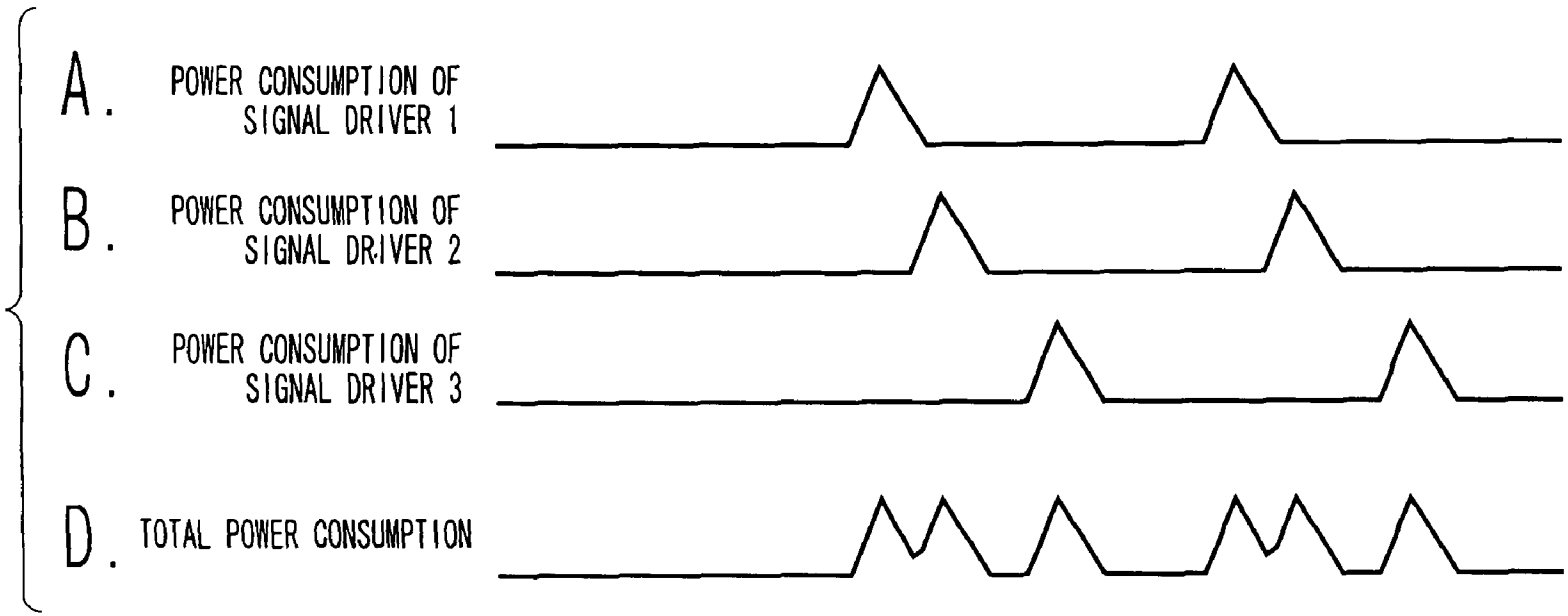
FIGS. 15A to 15D compose an illustration showing timings of currents consumed in each signal driver.
Figure 16:
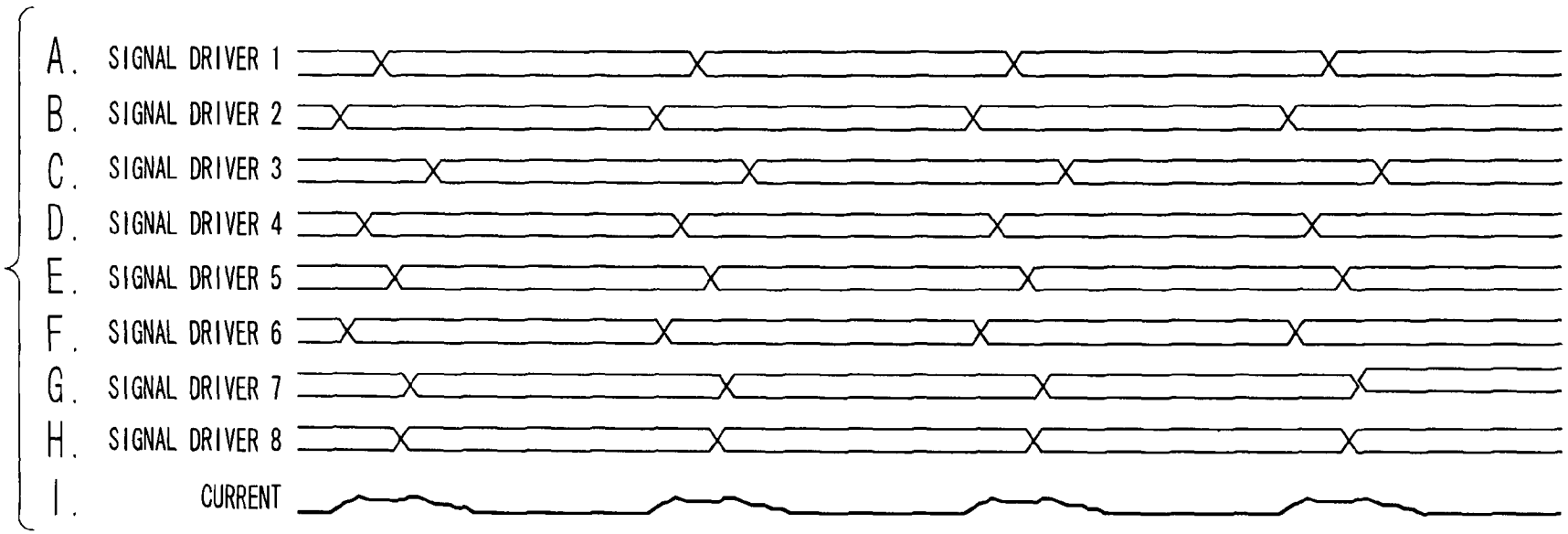
FIGS. 16A to 16I compose an illustration showing a relation between the timings at which the video data appears on the internal data bus and the amount of the current consumption.

FIGS. 14A to 14C compose a timing chart showing the timing at which the video data that is parallel-converted appears on the internal data bus by one group at a time in each of the signal drivers 1 to 3. In the signal driver 1, the video data received at a delay time Δt0=0 is sent out to the internal data bus by one group at a time after a passage of the time for reconstructing the data into the parallel form, and it is latched by a data latch by one group at a time. In the signal driver 2, the video data received at a delay time Δt1="transfer clock cycle of video data" is sent out to the internal data bus by one group at a time after the passage of the time for reconstructing the data into the parallel form, and it is latched by the data latch by one group at a time. In the signal driver 3, the video data received at a delay time Δt2="transfer clock cycle of video data" times 3 is sent out to the internal data bus by one group at a time after the passage of the time for reconstructing the data into the parallel form, and it is latched by the data latch by one group at a time.

FIGS. 15A to 15D compose a timing chart showing the timing of a current consumed in each signal driver. As shown in FIGS. 15A to 15D, there is a peak of the current generated in each of the signal drivers 1 to 3 every time the latch processing of the one group of video data is performed. However, in this embodiment, the timing controller 20 provides the different delay times Δt0, Δt1, and Δt3. Thus, the peaks of current do not overlap with each other. Therefore, there is no overlap in the total of currents consumed by the three signal drivers 1 to 3.

Now, there will be described the currents consumed when the different delay times Δt0, Δt1, - - - , Δt7 are set for the eight pieces of video data distributed to each signal driver. FIGS. 16A to 16I compose an illustration showing a relation between the current consumption and timing at which the video data appears on the internal data bus by one group at a time. In FIGS. 16A to 16H, the timing controller 20 shown in FIG. 8 sets the different delay times Δt0, Δt1, - - - , Δt7 for the video data of the signal drivers 1 to 8, respectively. As shown in the drawing, in each of the signal drivers 1 to 8, the video data appears on the internal bus by one group at a time, and the timing thereof is shifted by the differences of the respective delay times Δt0, Δt1, - - - , Δt7. Thus, the peaks of the currents consumed on each of the signal drivers do not overlap with each other. The whole currents consumed in the eight signal drivers 1 to 8 are dispersed as illustrated in the lowest row of FIG. 16I.

Figure 17:
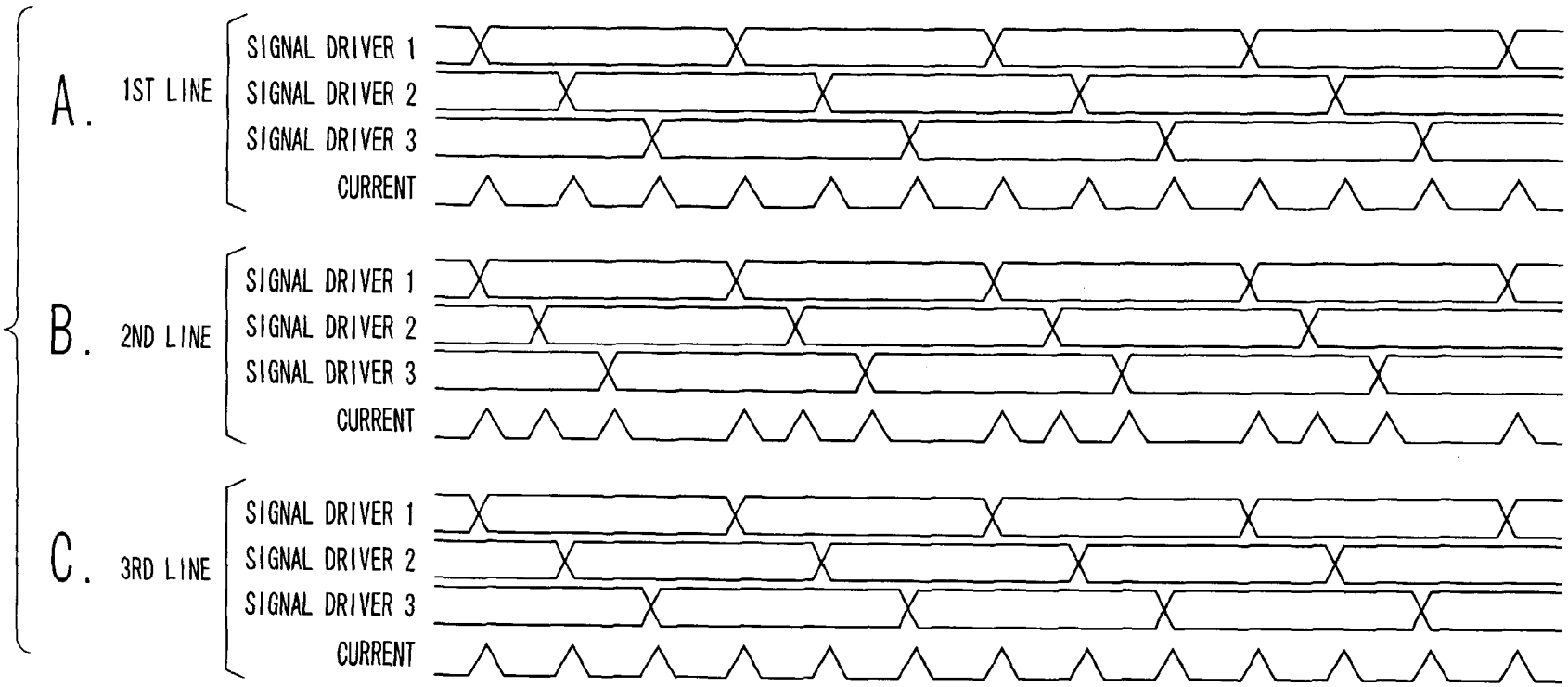
FIGS. 17A to 17C compose an illustration showing a relation between the timings at which the video data appears on the internal data bus and the amount of the current consumption.

(4) Subsequently, there will be described an embodiment for changing the delay times Δt0, Δt1, - - - , Δt7 temporally. As shown in FIG. 11, the timing controller 20 is capable of changing the delay times Δt0, Δt1, - - - , Δt7 at an arbitrary timing by setting a preset signal ON. In FIGS. 17A to 17C and FIG. 19, only the three signal drivers 1-3 will be discussed for simplifying the explanations. FIGS. 17A to 17C compose an illustration showing a relation between the amount of current consumption and the timing at which the video data appears on the internal data bus by one group at a time, when the delay time is temporally changed. In the drawing, a "1st line" shows an operation performed during a period where the video data displayed on the first line of the display panel 108 is latched by one group at a time. It is the same for a "2nd line" and a "3rd line". Assuming that the display panel 108 displays video data for one line of the panel in one horizontal period, the timing controller 20 sends out the video data of the "first line" in one horizontal period, sends out the video data of the "second line" in a next horizontal period, and sends out the video data of the "third line" in a horizontal period thereafter. In FIGS. 17A to 17C, delay times Δt0O, Δt1O, Δt2O set for the video data of odd-numbered lines are the same, delay times Δt0*e*, Δt1*e*, Δt2*e* set for the video data of even-numbered lines are the same, and the delay time set for the video data of the odd-numbered lines is different from a delay time set for the video data of the even-numbered lines. As shown in the drawing, timing for the "1st line" is the same as timing for the "3rd line" are the same, and the timing for the "1st line" is different from timing for the "2nd line".

Figure 18:
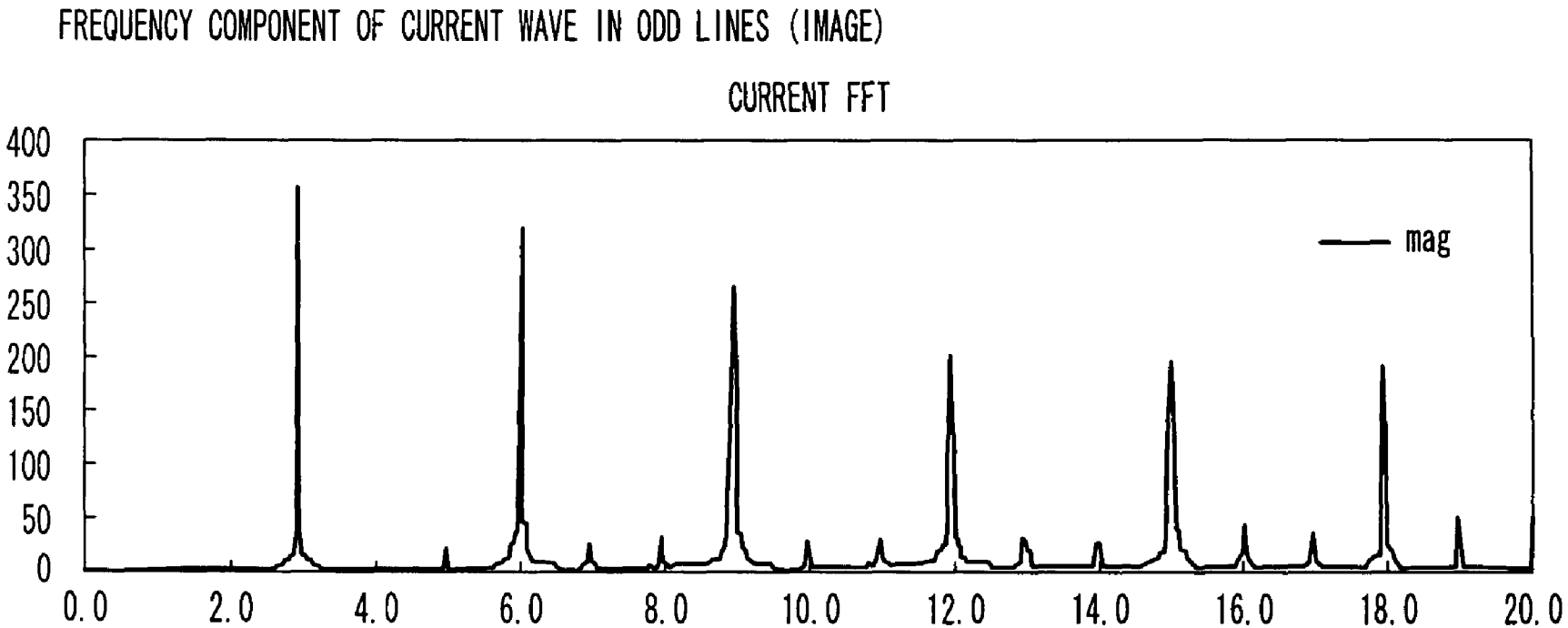
FIG. 18 is a graph showing a frequency component of a current wave on an odd-numbered line.
Figure 19:
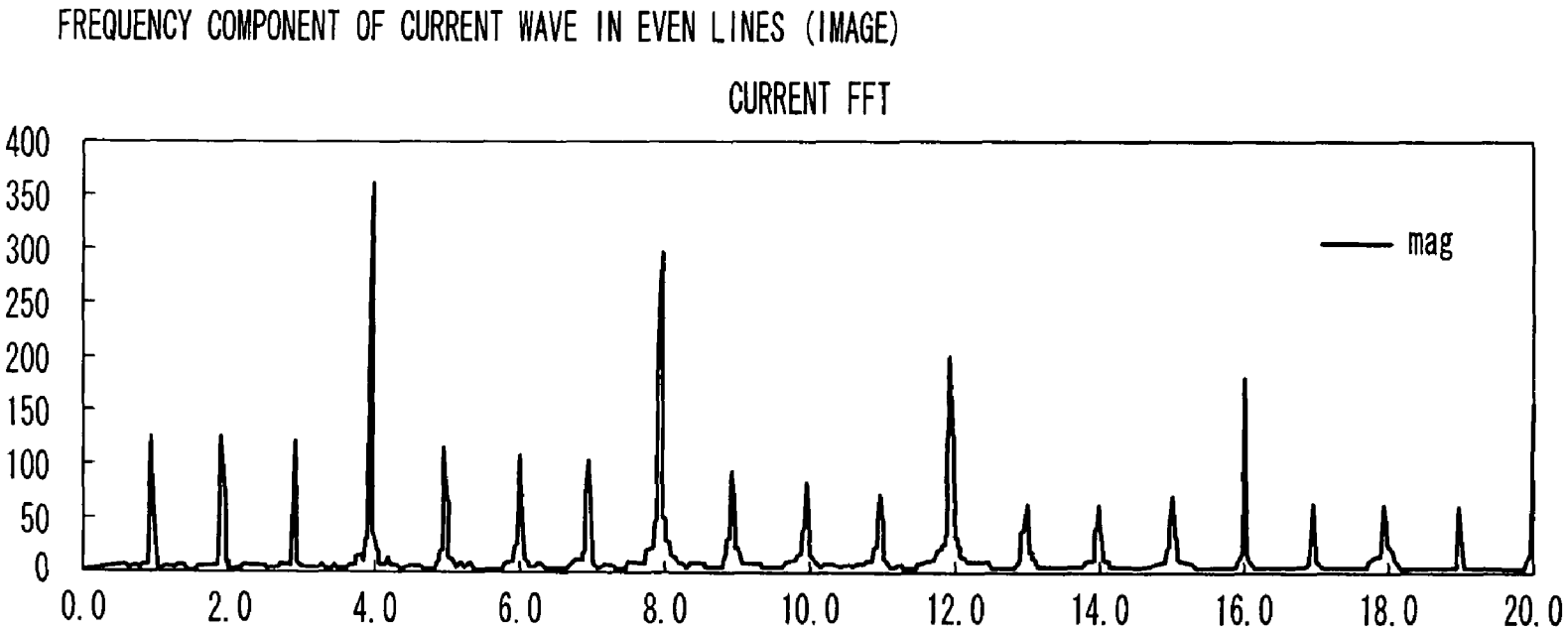
FIG. 19 is a graph showing a frequency component of a current wave on an even-numbered line.

FIG. 18 is a graph showing the frequency component of a current wave in a period where the three signal drivers 1 to 3 that have received the video data of the odd-numbered line ((2n+1)-th scanning line wherein the "n" is an integer) perform latch processing of the video data under the condition of FIGS. 17A to 17C. FIG. 19 is a graph showing the frequency component of a current wave in a period where the three signal drivers 1 to 3 that have received the video data of the even-numbered line ((2n)-th scanning line wherein the "n" is an integer) perform latch processing of the video data under the condition of FIGS. 17A to 17C. FIGS. 18 and 19 provide graphs showing a current FFT (Fast Fourier Transform) of the currents consumed in the signal drivers 1 to 3. The lateral axis shows the frequency in a unit of MHz. A longitudinal axis shows the magnitude. As shown in the graphs, the frequency component of the current wave in a period of an odd-numbered line shown in FIG. 18 is different from that in the period of an even-numbered line sown in FIG. 19. That is, since the intervals of generating supply current pulses are different between the odd-numbered line and the even-numbered line, the frequency components of electromagnetic radiation observed in EMI are to be dispersed as a result. Therefore, as in the case of the present embodiment, it is possible to suppress a concentration of energies to a specific frequency through changing the delay times Δt0, Δt1, - - - , Δt7 temporally.

Although the present invention has been described above in connection with several embodiments thereof, it would be apparent to those skilled in the art that those embodiments are provided solely for illustrating the present invention, and should not be relied upon to construe the appended claims in a limiting sense.

What is claimed is:

1. A flat panel display comprising:

a display panel;

a first signal driver configured to receive a first group video data and drive a first group signal line of the display panel in accordance with the first group video data;

a second signal driver configured to receive a second group video data and drive a second group signal line of the display panel in accordance with the second group video data;

a first data line;

a second data line;

a controller configured to control a timing of sending the first group video data to the first signal driver via the first data line, and a timing of sending the second group video data to the second signal driver via the second data line;

a delay time generating section configured to shift a relative timing between a timing at which the first signal driver receives the first group video data and a timing at which the second signal driver receives the second video data by a determined time, wherein the delay time generating section comprises a plurality of first-in-first out (FIFO) memories, wherein the plurality of FIFO memories includes a first FIFO memory comprising a plurality of flip-flop circuits that latch the video data, and wherein the first FIFO memory further comprises a read multiplexer that selects a flip-flop circuit of the plurality of flip-flop circuits to output the video data.

2. The flat panel display according to claim 1, wherein the delay time generating section is configured to generate the determined time to be shorter than a time determined by a product of:

bits per process of a video data at a latch process of the first signal driver to latch the received first group video data; and a clock cycle of a transfer of the first group or second group video data.

3. The flat panel display according to claim 1, wherein the delay time generating section is configured to generate the determined time to change temporally.

4. The flat panel display according to claim 3, wherein the delay time generating section is configured to keep the determined time to be a first constant value during a predetermined period, change the determined time into a second constant value, and keep the determined time to be the second constant value in a period next to the determined period.

5. The flat panel display according to claim 1, wherein the delay time generating section includes a circuit operated by a determined clock cycle being a same clock cycle of a transfer of the video data, and the delay time generating section is configured to generate the determined time based on the determined clock cycle.

6. The flat panel display according to claim 1, wherein the controller includes:

a line memory configured to retain a video data received by the flat panel display with partitioning the video data received by the flat panel display per display line of the display panel;

a serial converting part configured to convert first group video data with partitioning per display line retained in the line memory in a parallel form into a serial form, and convert second group video data with partitioning per display line retained in the line memory in a parallel form into a serial form; and an output amplifier configured to output first group video data converted in a serial form to the first data line, and output second group video data converted in a serial form to the second data line, and the delay time generating section is inserted between the serial converting part and the output amplifier.

7. The flat panel display according to claim 1, wherein the controller comprises the delay time generating section.

8. The flat panel display according to claim 1, wherein the delay time generating section generates a plurality of delay times including a first delay time and a second delay time, and wherein the controller sends the first group of video data to the first signal driver based on the first delay time and the second group of video data to the second signal driver based on the second delay time.

9. The flat panel display according to claim 8, wherein at least one of the plurality of delay times exceeds a transfer clock cycle of the video data.

10. The flat panel display according to claim 1, wherein the first signal driver has a peak current consumption that occurs at a first time, and the second signal driver has a peak current consumption that occurs at a second time, which is different than the first time.

11. The flat panel display according to claim 1, further comprising a plurality of data lines including the first data line and the second data line, wherein odd numbered data lines of the plurality of data lines have a first frequency component, and even numbered data lines of the plurality of data lines have a second frequency component of a current that is different than the first frequency component.

12. The flat panel display according to claim 1, wherein the controller delays sending the second group of video data according to a delay time generated by the delay time generating section.

13. The flat panel display according to claim 12, wherein the delay time generating section temporarily changes the delay time.

14. The flat panel display according to claim 13, wherein, when the delay time generating section temporarily changes the delay time, an energy consumed by the first and second signal drivers is concentrated to a specific frequency.

15. The flat panel display according to claim 1, wherein the controller sends the first group video data to the first signal driver via the first data line during a first period, and sends the second group video data to the second signal driver via the second data line during a second period occurring next after the first period.

16. The flat panel display according to claim 1, further comprising:

a plurality of odd data lines including the first data line; and a plurality of even data lines including the second data line, wherein the delay time generating section generates a first delay time for each data line of the plurality of odd data lines, and a second delay time being different than the first delay time for each data line of the plurality of even data lines.

* * * * *